US007945178B2

(12) United States Patent
Toyohara

(10) Patent No.: US 7,945,178 B2
(45) Date of Patent: May 17, 2011

(54) IMAGE FORMING APPARATUS INCLUDING DENSITY CONTROL AND CONTROL METHOD THEREOF

(75) Inventor: Yuichiro Toyohara, Fujisawa (JP)

(73) Assignee: Canon Kabushiki Kaisha (JP)

( * ) Notice: Subject to any disclaimer, the term of this patent is extended or adjusted under 35 U.S.C. 154(b) by 819 days.

(21) Appl. No.: 11/933,736

(22) Filed: Nov. 1, 2007

(65) Prior Publication Data

US 2008/0107434 A1 May 8, 2008

(30) Foreign Application Priority Data

Nov. 2, 2006 (JP) ..... 2006-299381

(51) Int. Cl.
*G03G 15/00* (2006.01)

(52) U.S. Cl. ..... 399/49; 399/72

(58) Field of Classification Search ..... 399/49, 399/72

See application file for complete search history.

(56) References Cited

U.S. PATENT DOCUMENTS

| | | | | |
|---|---|---|---|---|
| 7,206,531 | B2 * | 4/2007 | Suzuki et al. | 399/49 |
| 7,209,673 | B2 | 4/2007 | Suzuki et al. | |
| 7,359,652 | B2 * | 4/2008 | Kodama et al. | 399/49 |
| 7,450,866 | B2 * | 11/2008 | Sato | 399/49 |
| 7,457,556 | B2 * | 11/2008 | Sekiguchi et al. | 399/49 |

FOREIGN PATENT DOCUMENTS

| | | |
|---|---|---|
| JP | 2003-228201 A | 8/2003 |
| JP | 2005-189715 A | 7/2005 |

* cited by examiner

*Primary Examiner* — William J Royer
(74) *Attorney, Agent, or Firm* — Rossi, Kimms & McDowell LLP

(57) ABSTRACT

An image forming apparatus is provided that forms an image using developers of different tone and the same hue. When forming images for measurement for density control, the apparatus performs density control by forming a greater number of density levels of an image for measurement developed using a light developer than the number of density levels of an image for measurement developed using a dark developer. Thus, even if the amount of applied light developer may fluctuate, the fluctuation can be compensated to prevent the occurrence of pseudo-contours that lower image quality.

7 Claims, 19 Drawing Sheets

FIG. 1

| PATCH IMAGE FORMING SEQUENCE | PHOTO SENSOR 1 | PHOTO SENSOR 2 |
|---|---|---|
| 1 | YELLOW | BLACK |
| 2 | DARK MAGENTA | DARK CYAN |
| 3 | LIGHT MAGENTA AT HIGH DENSITY | LIGHT CYAN AT HIGH DENSITY |
| 4 | LIGHT MAGENTA AT LOW DENSITY | LIGHT CYAN AT LOW DENSITY |

FIG. 3B

| | |
|---|---|
| SYSTEM PROGRAM (OS) | 201 |
| DENSITY CONTROL PROGRAM | 202 |
| ORIGINAL IMAGE DENSITY-OUTPUT IMAGE DENSITY CONVERSION TABLE | 203 |
| HIGH DENSITY PORTION CORRECTION AMOUNT TABLE<br>LOW DENSITY PORTION CORRECTION AMOUNT TABLE | 204 |
| PATCH IMAGE DATA<br>(YELLOW, BLACK, DARK MAGENTA, DARK CYAN<br>LIGHT MAGENTA AT HIGH DENSITY,<br>LIGHT MAGENTA AT LOW DENSITY<br>LIGHT CYAN AT HIGH DENSITY,<br>LIGHT CYAN AT LOW DENSITY) | 205 |
| PATCH IMAGE COMBINATIONS<br>(YELLOW, BLACK) (DARK MAGENTA, DARK CYAN)<br>(LIGHT MAGENTA AT HIGH DENSITY,<br>LIGHT CYAN AT HIGH DENSITY)<br>(LIGHT MAGENTA AT LOW DENSITY,<br>LIGHT CYAN AT LOW DENSITY) | 206 |
| PRINT JOB INFORMATION<br>(IMAGE SIZE, SPACE BETWEEN SHEETS)<br>IMAGE DATA | 207 |
| VARIOUS FLAGS<br>(RESULT OF DETERMINING REMAINDER OF SHEET COUNT VALUE,<br>COMPLETION DETERMINATION RESULT) | 208 |
| SET SHEET COUNT VALUE M<br>DETECTED SHEET COUNT VALUE N<br>REMAINDER OF SHEETS COUNT VALUE/4(6) | 209 |
| PROGRAM LOAD AREA | 210 |
| | |

| REMAINDER OF SHEET COUNT VALUE / 4 | PHOTO SENSOR 1 | PHOTO SENSOR 2 |
|---|---|---|
| 1 | YELLOW | BLACK |
| 2 | DARK MAGENTA | DARK CYAN |
| 3 | LIGHT MAGENTA AT HIGH DENSITY | LIGHT CYAN AT HIGH DENSITY |
| 4 | LIGHT MAGENTA AT LOW DENSITY | LIGHT CYAN AT LOW DENSITY |

FIG. 12

| PATCH IMAGE FORMING SEQUENCE | PHOTO SENSOR 1 | PHOTO SENSOR 2 |
|---|---|---|
| 1 | YELLOW | BLACK |
| 2 | DARK MAGENTA | DARK CYAN |
| 3 | LIGHT MAGENTA AT HIGH DENSITY | LIGHT CYAN AT HIGH DENSITY |
| 4 | YELLOW | BLACK |
| 5 | DARK MAGENTA | DARK CYAN |
| 6 | LIGHT MAGENTA AT LOW DENSITY | LIGHT CYAN AT LOW DENSITY |

| REMAINDER OF SHEET COUNT VALUE / 6 | PHOTO SENSOR 1 | PHOTO SENSOR 2 |
|---|---|---|
| 1 | YELLOW | BLACK |
| 2 | DARK MAGENTA | DARK CYAN |
| 3 | LIGHT MAGENTA AT HIGH DENSITY | LIGHT CYAN AT HIGH DENSITY |
| 4 | YELLOW | BLACK |
| 5 | DARK MAGENTA | DARK CYAN |
| 6 | LIGHT MAGENTA AT LOW DENSITY | LIGHT CYAN AT LOW DENSITY |

IMAGE FORMING APPARATUS INCLUDING DENSITY CONTROL AND CONTROL METHOD THEREOF

BACKGROUND OF THE INVENTION

1. Field of the Invention

The present invention relates to an electrophotographic image forming apparatus that includes developers of the same hue and different densities, a control method thereof, and a storage medium, and more particularly to density control of an image forming apparatus.

2. Description of the Related Art

Accompanying the recent advances in image forming apparatuses, the level of needs relating to image quality has also increased. Electrophotographic image forming apparatuses have been proposed in which the number of colors is increased in comparison to the conventional image forming apparatuses that use toners (developers) of four colors, and some of those electrophotographic image forming apparatuses have been put into practical use.

For example, image forming apparatuses exist which add the toner colors of red, blue and green or gold, silver and fluorescent colors to the four conventional toner colors of cyan, magenta, yellow and black. Further, in the inkjet system, image forming apparatuses exist which add the toner colors of pale cyan and pale magenta to the four toner colors of cyan, magenta, yellow and black. In this specification, normal cyan and normal magenta are referred to as "dark cyan" and "dark magenta", and pale cyan and pale magenta are referred to as "light cyan" and "light magenta". The purpose of adding developers in this manner is to improve the respective image qualities. For example, an image forming apparatus in which toner of pale colors such as light cyan and light magenta are additionally provided, generally has a purpose of decreasing granularity, and is used as an image forming apparatus that is capable of achieving photograph-like high image quality.

Meanwhile, in image forming apparatuses according to the electrophotographic method, various controls are performed to enable stable image output with respect to fluctuations in the characteristics of image forming parameters (for example, developing bias) due to the influence of environmental conditions and the like. Further, in order to suppress increases in the image forming time due to such controls, attempts are made to realize effective control for stabilizing an image in a short time. For example, Japanese Patent Laid-Open No. 2003-228201 (hereinafter referred as JPA 2003-228201) discloses an effective image stabilizing control method that controls all tones using a single image for measurement.

In many cases of these image stabilizing controls, control is performed so as to most stably reproduce variations in sensitive range with respect to the visual sensitivity of humans. With respect to density, since humans are more liable to react to image quality or tints of slightly light portions of halftones than to those of dark portions, in many cases control is performed that places importance on those regions.

However, in a six-color image forming apparatus that uses toners for light cyan and light magenta (light toners) as well as black, yellow, normal cyan (dark toner), and normal magenta (dark toner), the relation between density on which importance should be placed and amount of applied toner changes with respect to dark toner and light toner.

Further, with regard to cyan and magenta, since a tone of a single color is reproduced by combining dark toner and light toner, the characteristics of a high density portion of light toner and a low density portion of dark toner are important.

The problem thus arises that it is impossible to control all tones using a single image for measurement as described in JPA 2003-228201. More specifically, because of reproducing a tone of a single color by combining dark toner and light toner, when the stability of reproduction of a high density portion of light toner or a low density portion of dark toner is impaired, problems arise with respect to image quality, such as the occurrence of pseudo-contours.

SUMMARY OF THE INVENTION

The present invention was accomplished having taken the above described problem of the prior art as a starting point. An object of the present invention is to provide an image forming apparatus that, when forming images using at least one set of developers of the same hue and different tone, forms images having a stabilized high image quality by suppressing a change of hue even when the amounts of applied developers or the like are influenced due to fluctuations in environmental or image forming conditions, and a control method thereof.

An image forming apparatus according to the present invention for achieving the above described objects has the following configuration.

An image forming apparatus comprises: an image forming portion adapted to form images representing a same hue by a combination of developers having different tone; a measurement image forming portion adapted to form images for measurement in an area between the images to be formed on an image carrier using the image forming portion during forming images in succession transferred on a plurality of recording media; a measurement portion adapted to measure densities of the images for measurement; and a density adjusting portion adapted to adjust densities of the images formed by the image forming portion, based on the densities of the images for measurement measured by the measurement portion, wherein the measurement image forming portion forms images for measurement so that a number of density levels of images for measurement developed using a light developer for a same hue is larger than a number of density levels of images for measurement developed using a dark developer for the same hue.

The apparatus further comprises a setting portion adapted to make a setting such that a density level of at least an image for measurement among a plurality of images for measurement developed using the light developer is higher than a density level of the image for measurement developed using the dark developer.

The density level of at least an image for measurement among a plurality of images for measurement developed using the light developer is 70% or more level of a maximum density of images formed using the light developer. The measurement image forming portion controls the image forming portion so that images for measurement developed using the light developer and images for measurement developed using the dark developer are formed at a same frequency. The image forming apparatus includes developing portions for hues of cyan, magenta and yellow, and develops hues of cyan or magenta with a combination of a light developer and a dark developer.

Further, a method of controlling an image forming apparatus which forms images representing at least a same hue by a combination of developers having different tone, comprises the steps of: forming images for measurement in an area between images to be formed on an image carrier during forming images in succession transferred on a plurality of recording media; measuring densities of the images for measurement; and adjusting densities of the images formed in the image forming step, based on the densities of the images for measurement measured in the measuring step, wherein in the step of forming images for measurement, images for measurement are formed so that a number of density levels of images for measurement developed using a light developer for a same hue is larger than a number of density levels of images for measurement developed using a dark developer for the same hue.

According to the present invention, an image forming apparatus that, when forming images using at least one set of developers of the same hue and different tone, forms images having a stabilized high image quality by suppressing a change of hue even when the amounts of applied developers are influenced due to fluctuations in environmental or image forming conditions, and a control method thereof can be provided.

Further features of the present invention will become apparent from the following description of exemplary embodiments with reference to the attached drawings.

BRIEF DESCRIPTION OF THE DRAWINGS

The accompanying drawings, which are incorporated in and constitute a part of the specification, illustrate embodiments of the invention and, together with the description, serve to explain the principles of the invention.

FIG. 1 is a view that describes the sequence and combination of patch images that are formed according to a first embodiment;

FIG. 3B is a view showing one example of a configuration of a ROM and a RAM in the control configuration of FIG. 3A;

FIG. 12 is a view that describes the sequence and combination of patch images that are formed according to a second embodiment;

DESCRIPTION OF THE EMBODIMENTS

First Embodiment

[Characteristics of the First Embodiment]

According to the present image forming apparatus, when forming images for measurement for density control (hereunder, referred to as "patch images"), patch images formation can be carried out such that in a same hue, the number of patch images (number of density levels) developed using light developer is greater than the number of patch images (number of density levels) developed using dark developer. It is also possible to detect the density of a patch image that is formed and perform regulatory control of the image density based on the detected patch image density. Consequently, when using a combination of developers that have the same hue and different tone, even if the amount of the applied light developer is influenced due to fluctuations in environmental conditions such as temperature and humidity or image forming conditions such as a developing bias, it is possible to compensate those fluctuations in order to prevent the occurrence of pseudo-contours that lower the image quality. It is therefore possible to suppress fluctuations in image quality or tints of slightly light portions of halftones that humans can sensitively distinguish, and perform control so as to most stably reproduce variations in sensitive range with respect to the visual sensitivity of humans.

Hereunder, the image forming apparatus of the present invention is described in detail with reference to the drawings.

Figure 2A:
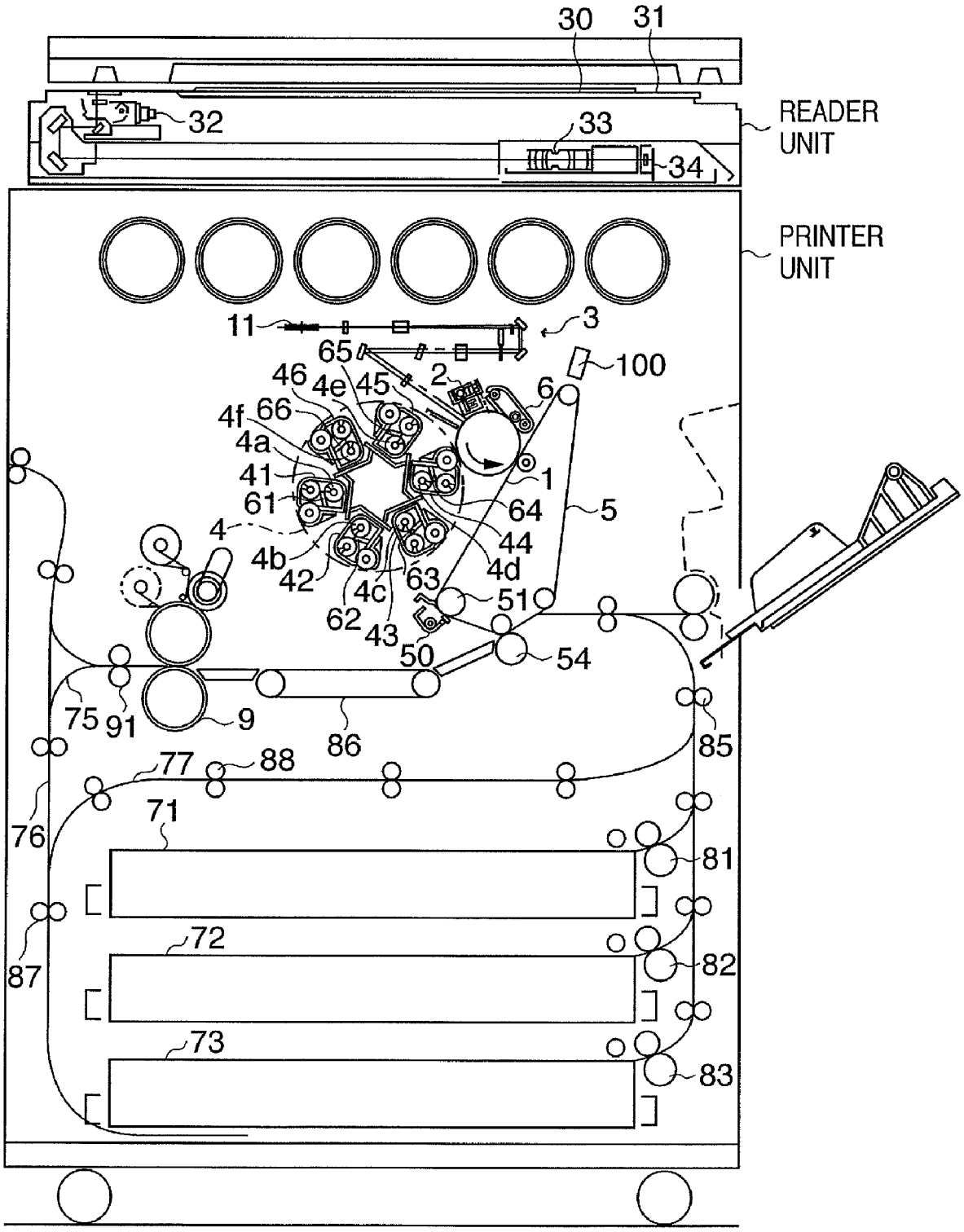
FIG. 2A is a cross sectional view showing an outline configuration of a color image forming apparatus according to the first embodiment.
Figure 2B:
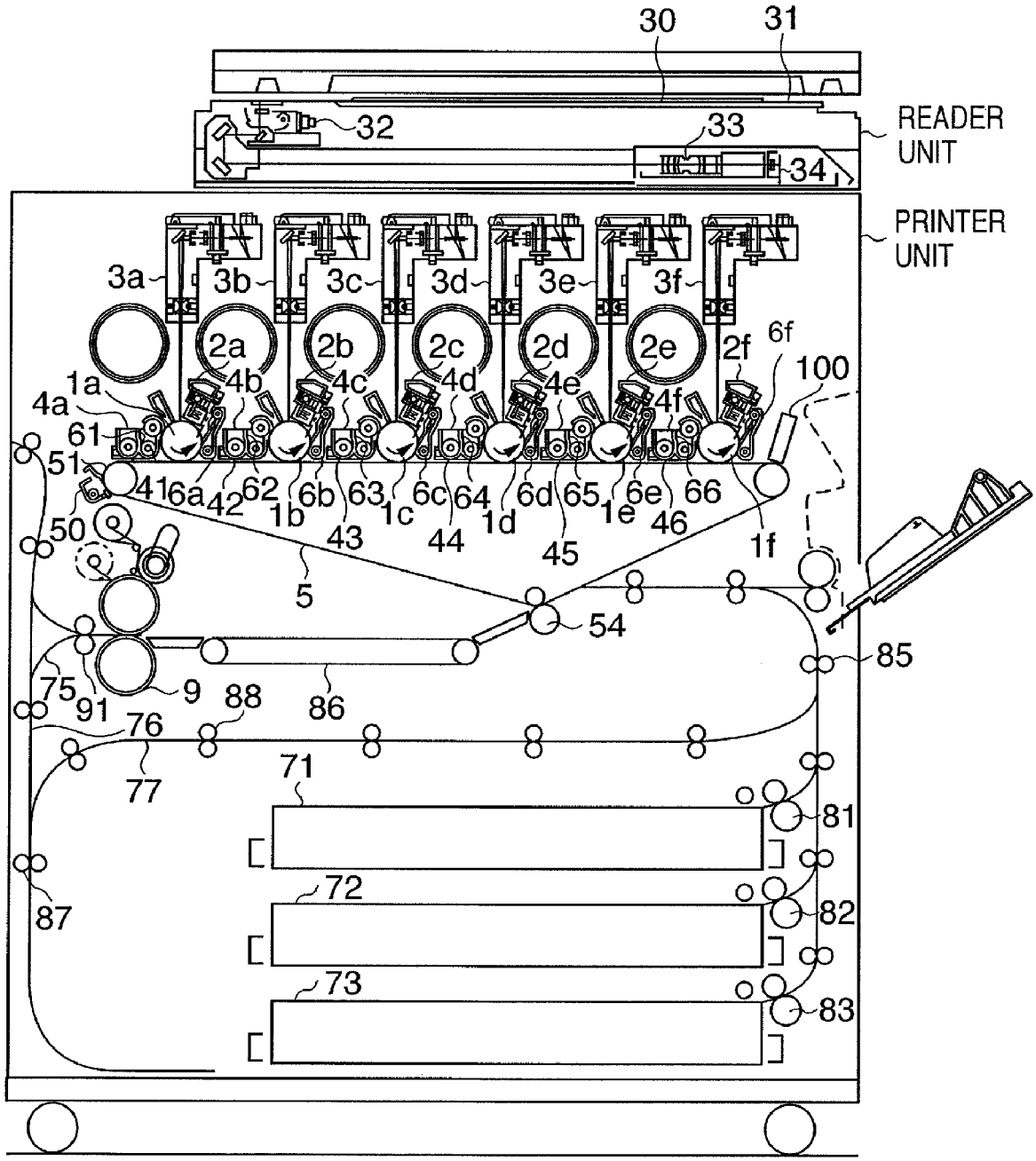
FIG. 2B is a cross sectional view showing an outline configuration of another color image forming apparatus according to the first embodiment.

[Image Forming Apparatus: FIGS. 2A and 2B]

FIG. 2A is a cross sectional view that shows the outline configuration of a color image forming apparatus as one example of an image forming apparatus according to the present embodiment.

As shown in FIG. 2A, the present image forming apparatus has a reader unit at an upper part and a printer unit at a lower part. In this connection, since the effects described below can be similarly obtained when, instead of the configuration shown in FIG. 2A, the present image forming apparatus is according to a tandem system in which image forming units for each development color are provided side by side as shown in FIG. 2B, either of these systems may be adopted. The following description is made using FIG. 2A. For the apparatus shown in FIG. 2B, reference numerals that are common to corresponding portions in FIG. 2A are assigned to the portions of the apparatus shown in FIG. 2B, and a description of those corresponding portions is omitted.

In the reader unit shown in FIG. 2A, an original 30 is placed on a platen glass 31, and a reflection light image from the original 30 obtained by performing exposure scanning using an exposure lamp 32 is focused on a full-color CCD sensor 34 through a lens 33 to obtain color separated image signals. The color separated image signals are amplified by an unshown amplification circuit, and thereafter are processed by an unshown video processing unit, and sent to the printer unit via an unshown image memory.

In addition to signals from the reader unit, image signals from a computer and image signals from a facsimile machine are also similarly sent to the printer unit. Hereunder, a description of the operation of the printer unit is given based on signals from the reader unit as a representative of these signals.

In the printer unit, a photosensitive drum 1 as an image carrier is supported for rotation in the direction of an arrow shown in the figure. Around the photosensitive drum 1 are disposed a pre-exposure lamp, a corona primary charger 2, a laser exposure optical system 3, a potential sensor, a rotary developing unit holder 4, six developing units 41 to 46 disposed in the rotary developing unit holder 4 that are filled with toners of differing spectral characteristics, a transfer unit, and a cleaning unit 6.

In the tandem system of FIG. 2B, around photosensitive drums 1*a*-1*f* are respectively disposed pre-exposure lamps, corona primary chargers 2*a*-2*f*, laser exposure optical systems 3*a*-3*f*, potential sensors, six developing units 41 to 46 that are filled with toners of differing spectral characteristics, transfer units, and cleaning units 6*a*-6*f*.

In the developing units 41 to 46, dark cyan toner is filled into a toner holder 4*a*, dark magenta toner is filled into a toner holder 4*b*, yellow toner is filled into a toner holder 4*c*, black toner is filled into a toner holder 4*d*, light cyan toner is filled into a toner holder 4*e*, and light magenta toner is filled into a toner holder 4f. Although a two-component developer in which toner and carrier are blended for use is filled into the present developing units 41 to 46, a one-component developer consisting of only toner may also be used. Further, although combinations of different tone relating to the two colors of cyan and magenta are provided as kinds of toner, the kinds of toner are not limited to those two colors of cyan and magenta, and may be cyan only, magenta only, yellow only or the like. Further, though the number of developing units 41 to 46 according to the present embodiment is six, any number of developing units may be used as long as the number is five or more.

In the laser exposure optical system 3, an image signal from the reader unit is converted into a light signal in a laser output unit not shown. The laser light corresponding to the converted light signal is reflected by a polygon mirror so that it is projected onto the surface of the photosensitive drum 1 through a lens and respective reflection mirrors.

At the time of image formation at the printer unit, the photosensitive drum 1 is rotated in the direction of the arrow. After a charge of the photosensitive drum 1 is eliminated by the pre-exposure lamp, the photosensitive drum 1 is uniformly charged by the corona primary charger 2, and then exposed by each laser light of separated color to form electrostatic latent images on the photosensitive drum 1. Next, the rotary developing unit holder 4 is rotated to move and set a predetermined developing unit (41 to 46) to a developing position on the photosensitive drum 1. Thereafter, that developing unit (41 to 46) is operated to develop a latent image on the photosensitive drum 1 so that an image of toner comprising resin and pigment as base materials is formed on the photosensitive drum 1.

Further, as shown in FIG. 2A, toner containing units (hoppers) 61 to 66 for each color are disposed between and beside the laser exposure optical system 3. The developing units 41 to 46 are supplied with toner from these hoppers 61 to 66 as necessary at a desired timing so as to maintain a constant toner ratio (or toner amount) in the developing units.

Toner images that are formed on the photosensitive drum 1 are subjected to primary transfer onto an intermediate transfer belt 5 at the transfer unit to sequentially superpose the respective toner images on the intermediate transfer belt 5. The intermediate transfer belt 5 is driven by a drive roller 51. A transfer cleaning unit 50 is provided at a position opposing the drive roller 51 to sandwich the intermediate transfer belt 5 in a condition in which it can contact and separate therefrom. A photo sensor 100 is disposed above the intermediate transfer belt 5, and can detect an amount of toner on the intermediate transfer belt 5 by reading a patch image.

After piling of images of the required colors onto the intermediate transfer belt 5 is completed, the transfer cleaning unit 50 applies pressure to the drive roller 51 to clean residual toner that remains on the intermediate transfer belt 5 after transferred onto a transfer member.

The transfer member is conveyed by one sheet at a time from respective storage units 71, 72, and 73, by paper supply means 81, 82, and 83. Skew conveying is corrected at registration rollers 85, and the transfer member is conveyed to a secondary transfer unit 54 that transfers a superposed toner image on the intermediate transfer belt 5 onto the transfer member at a desired timing.

The superposed toner image is transferred onto the transfer member at the secondary transfer unit 54, the transfer member passes through a conveying unit 86, the toner image is fixed to the transfer member at a heat roller fixing unit 9, and the transfer member is then discharged onto a paper discharge tray or an unshown post-processing unit.

Meanwhile, after completion of the secondary transfer, the residual toner on the intermediate transfer belt 5 is cleaned as described above by the transfer cleaning unit 50. Thereafter, the intermediate transfer belt 5 is again supplied for the primary transfer process at the image forming unit.

Further, when forming an image on both sides of a transfer member, a conveying path guide 91 is driven immediately after the transfer member passes the fixing unit 9. Subsequently, after temporarily guiding the transfer member to a reversing path 76 via a conveying path 75, the rear end, when the transfer member is fed, is made the front end by reversal of reversing rollers 87, and the transfer member is drawn in the opposite direction to the feeding direction to be sent to a two-sided conveying path 77. Thereafter, the transfer member passes through the two-sided conveying path 77 to undergo skew conveying correction and timing acquisition at two-sided conveying rollers 88, conveyed at a desired timing to the registration rollers 85, and an image for back surface is then transferred onto the other side by again undergoing the above described image forming process.

Figure 3A:
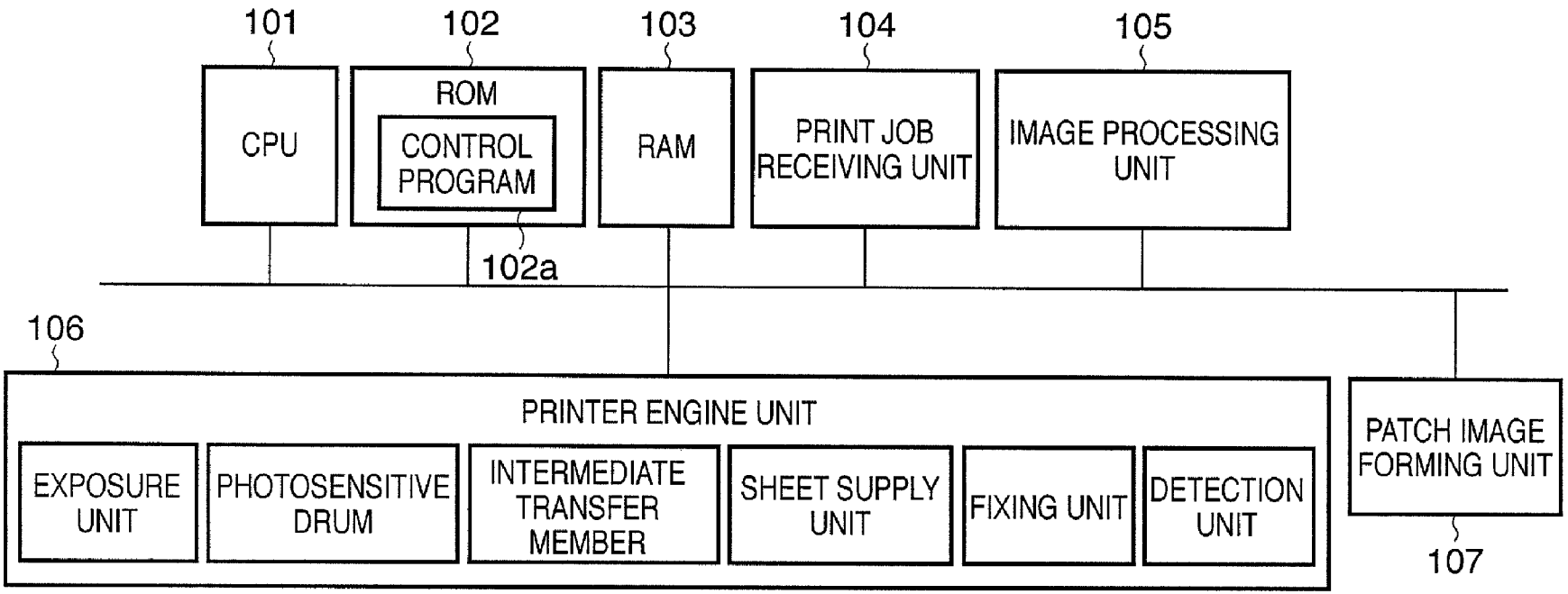
FIG. 3A is a block diagram that shows one example of the control configuration of a present image forming apparatus.

[Control Configuration of Image forming Apparatus: FIG. 3A]

FIG. 3A is a block diagram showing one example of the control configuration of the image forming apparatus shown in FIG. 2A or FIG. 2B.

Reference numeral 101 denotes a CPU that controls the overall image forming apparatus. Reference numeral 102 denotes a ROM that stores various kinds of control programs and various kinds of data. Reference numeral 103 denotes a RAM. Reference numeral 104 denotes a print job receiving unit. Reference numeral 105 denotes an image processing unit. Reference numeral 106 denotes a printer engine unit. Reference numeral 107 denotes a patch image forming unit. The printer engine unit 106 comprises an exposure unit, a photosensitive drum, an intermediate transfer member, a sheet supply unit, a fixing unit, a detection unit and the like. Based on an image forming control program 102*a* that is stored in the ROM 102, the CPU 101 can perform various kinds of processing by controlling each unit using the RAM 103 as a work area. For example, it is necessary to switch the print speed depending on the kind of recording medium, and the CPU 101 can perform adjustment so as to suppress an increase in image forming time that occurs when switching a print speed during successive image forming processes using different kinds of recording media.

[Configuration of ROM/RAM: FIG. 3B]

Next, one example of the configuration of the aforementioned ROM 102 and RAM 103 will be described using FIG. 3B. In this connection, the components necessary for describing the present embodiment are mainly shown in FIG. 3B, and components that are not necessary for describing the present embodiment are omitted therefrom.

Reference numerals 201-206 in FIG. 3B denote storage areas of the ROM 102. In the ROM 102 as shown in FIG. 3B, a system program is stored in the area denoted by reference numeral 201, and a density control program is stored in the area denoted by reference numeral 202. Further, an original image density—output image density conversion table (γ-conversion table) is stored in the area denoted by reference numeral 203, a high density portion correction amount table and a low density portion correction amount table are stored in the area denoted by reference numeral 204, and patch image data is stored in the area denoted by reference numeral 205. Data for forming various kinds of patch images including patch images of yellow, black, dark magenta, dark cyan, light magenta at high density, light magenta at low density, light cyan at high density and light cyan at low density is stored in the patch image data 205. Combinations of patch images to be formed are stored in the area denoted by reference numeral 206. For example, the combinations include (yellow, black), (dark magenta, dark cyan), (light magenta at high density, light cyan at high density), and (light magenta at low density, light cyan at low density).

Figure 9:
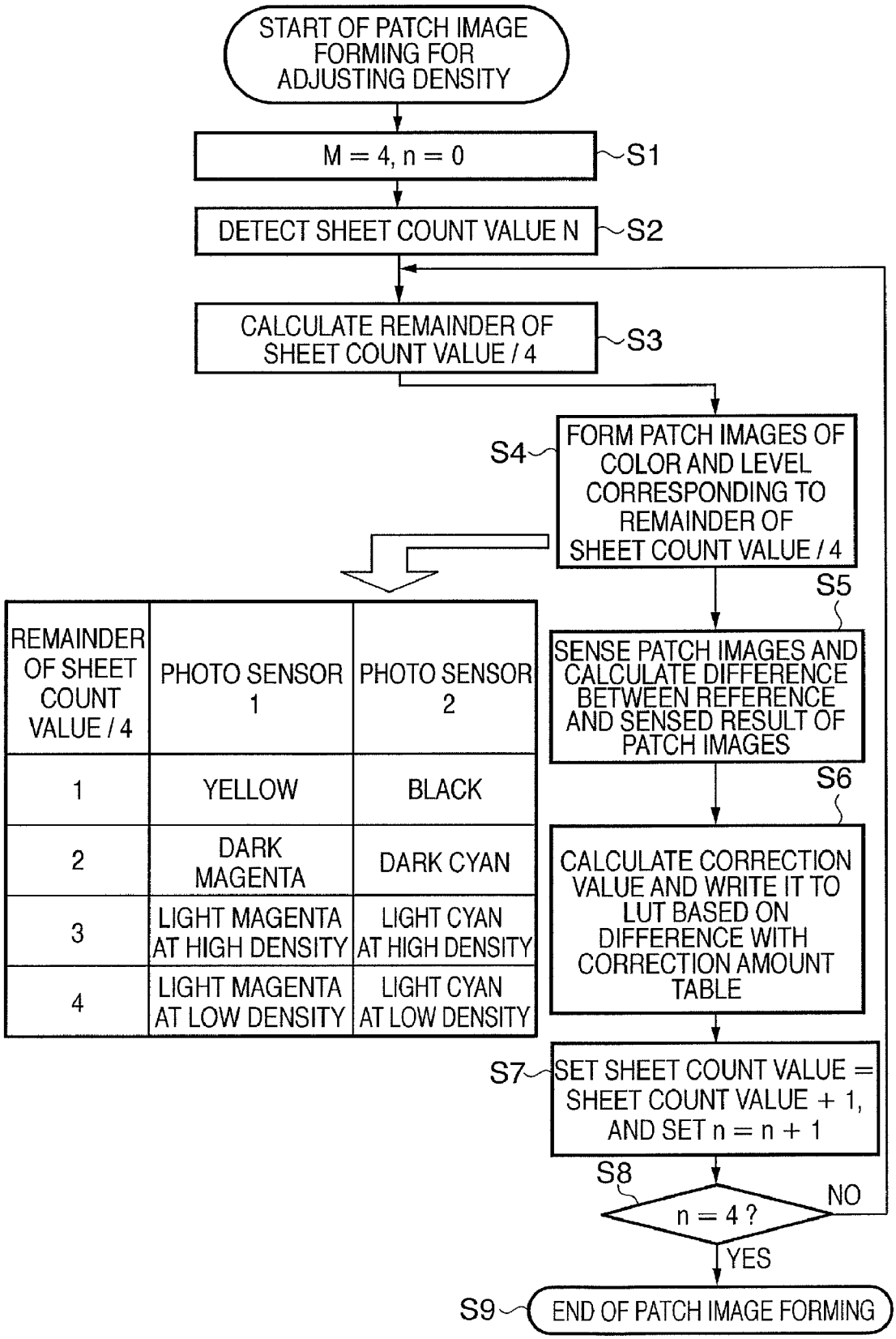
FIG. 9 is a flowchart that illustrates tone control processing in the color image forming apparatus according to the first embodiment.

Reference numerals 207-210 in FIG. 3B denote storage areas of the RAM 103. In the RAM 103, image data used for forming image at various print jobs and print job information (image size, distance between images and the like) is stored in the area denoted by reference numeral 207. Various flags (result of determining remainder of sheet count value, and completion determination result) and the like that are required when executing the program illustrated in FIG. 9 are stored in the area denoted by reference numeral 208. In the area denoted by reference numeral 209 are stored set sheet count value M, detected sheet count value N, a remainder of sheet count value and the like. The area denoted by reference numeral 210 is a program load area.

Figure 4:
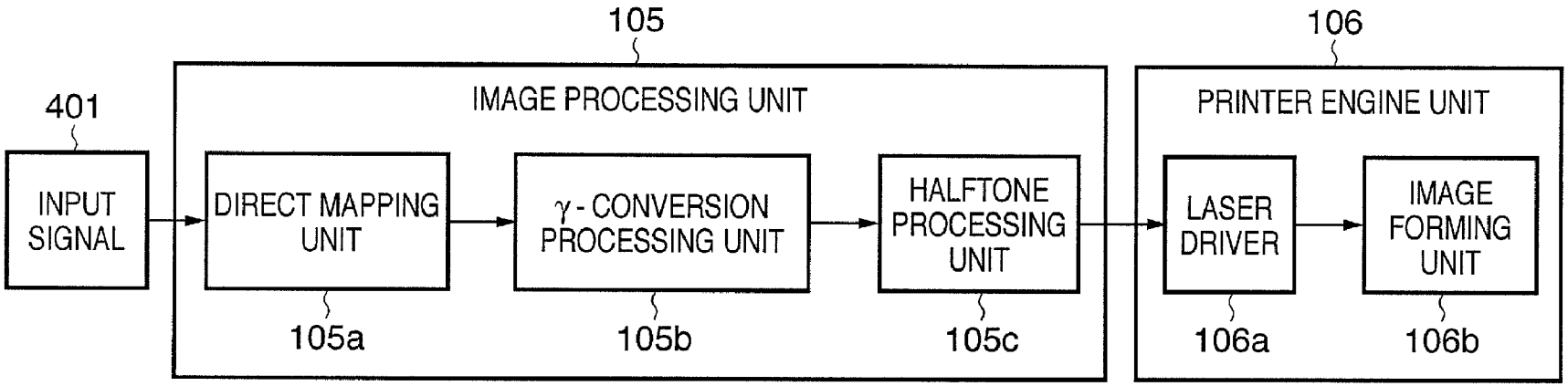
FIG. 4 is a block diagram that illustrates image processing performed by the present image forming apparatus.

[Image Processing: FIG 4]

A block diagram illustrating image processing performed by the present image forming apparatus is shown in FIG. 4.

An input signal 401 shown in FIG. 4 represents a signal from the reader unit or an image signal that is sent on an unshown network. This input signal 401 undergoes color separation into the six colors of dark cyan, dark magenta, yellow, light cyan, light magenta, and black at a direct mapping unit 105*a* of the image processing unit 105. The image data is then subjected to conversion at a γ-conversion processing unit 105*b*, and sent to the printer engine unit 106 after halftone processing is performed by a halftone processing unit 105*c*. At the printer engine unit 106, image formation is carried out by an image forming unit 106*b* based on the received image data by performing image exposure via a laser driver 106*a*.

Figure 5:
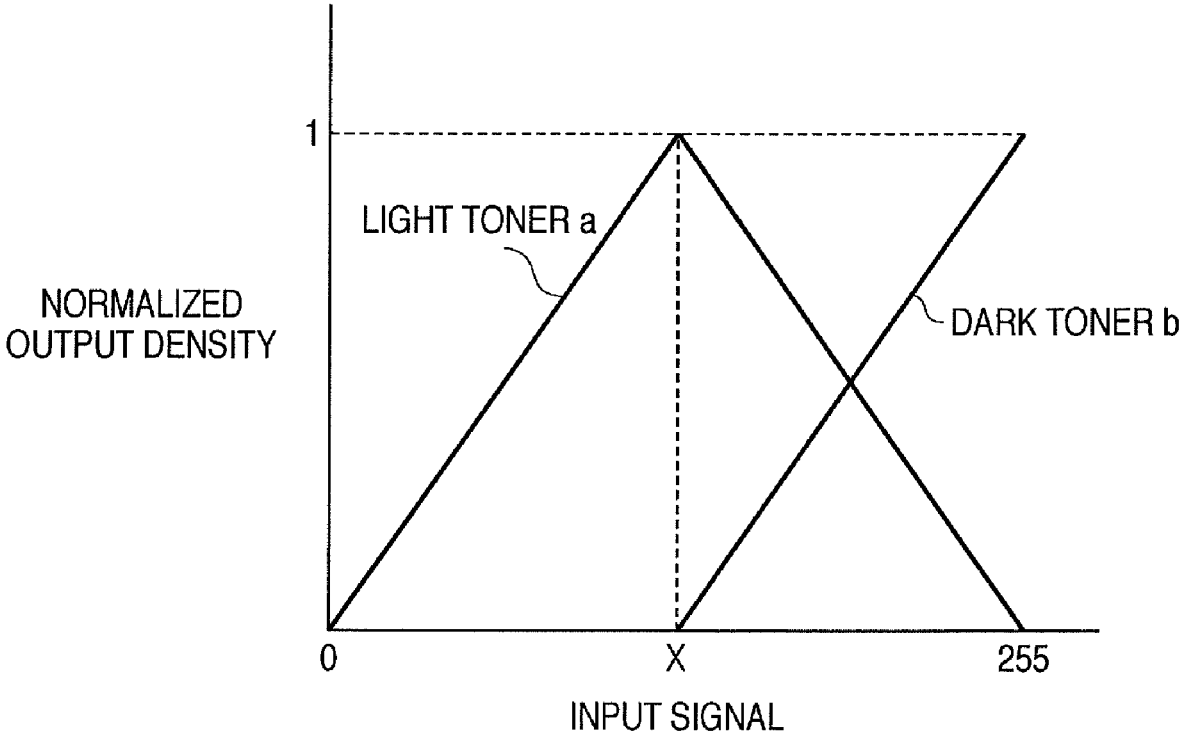
FIG. 5 is a schematic view that shows output characteristics of each toner with respect to combinations of dark and light toners.

[Color Separation Using Dark Toner and Light Toner: FIG 5]

FIG. 5 shows a schematic view illustrating output characteristics of each toner produced by combining dark toner (dark cyan) and light toner (light cyan) for cyan as an example in relation to the above described dark and light color separation.

The ordinate of FIG. 5 represents normalized output densities that are normalized at the respective maximum densities of dark toner (dark cyan) and light toner (light cyan) with a mixed ratio in a combination (blend) of the dark toner and light toner. The abscissa of FIG. 5 represents input signals. In this connection, although the maximum values for the normalized output densities of the dark toner and the light toner are described as equal (1 in the figure) in the illustration of normalized output densities in FIG. 5, the actual color densities are different for dark toner and light toner.

As shown in FIG. 5, when reproducing tones of dark and light by combining two toners comprising a light toner a and a dark toner b, a density of the light toner a is a maximum density at the position X shown in FIG. 5. As the input signal is larger from the position X, the smaller amount of the light toner a and the larger amount of the dark toner b are combined for image forming. Subsequently, by combining and joining together tones formed using the light toner and tones formed using the dark toner, tones can be consecutively reproduced.

Figure 6:
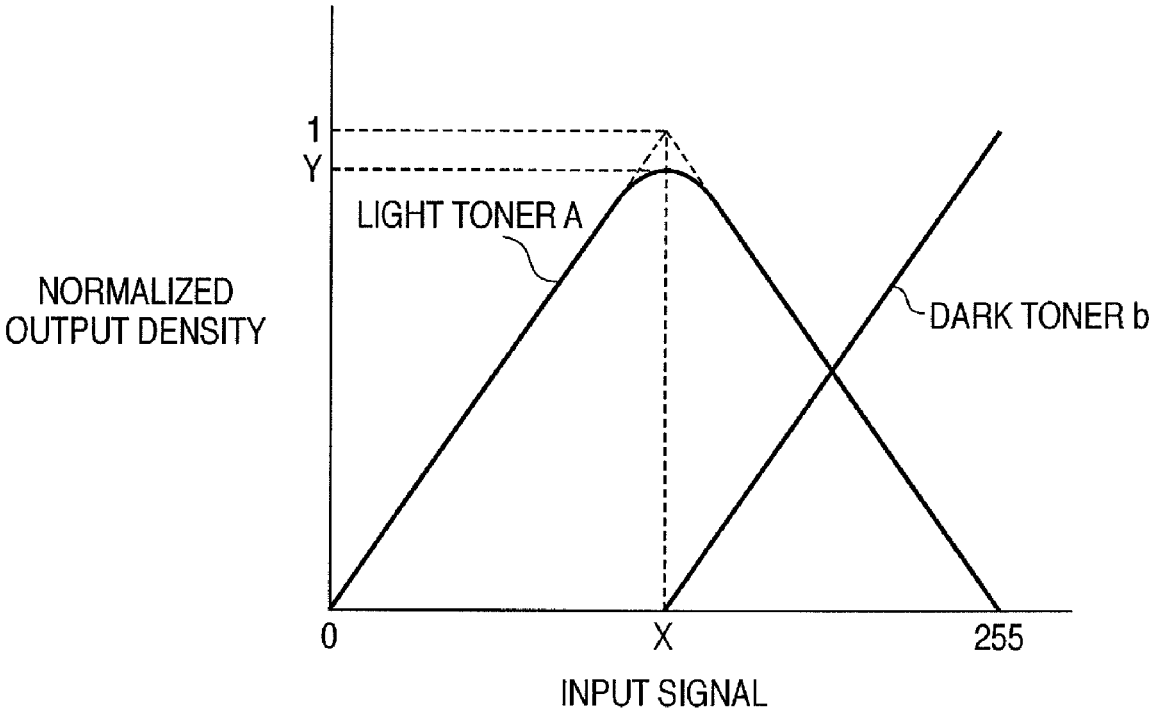
FIG. 6 is a schematic view that illustrates output characteristics of each toner in a case in which the maximum density of the light toner of FIG. 5 is lowered.

[Reduction In Maximum Density of Light Toner: FIG 6]

If a case is assumed in which the maximum density of the light toner decreases when reproducing light to dark tone by combining two toners consisting of a dark toner and a light toner as shown in FIG. 5, the characteristics shown in FIG. 5 change in the manner shown in FIG. 6. More specifically, the maximum value of the normalized output density of the light toner A is lowered at the vicinity of the position X as shown in FIG. 6. As a cause by which the maximum density of the light toner is lowered, for example, a case can be considered in which an amount of applied toner on a photosensitive drum, an intermediate transfer member or a recording medium or the like varies due to fluctuations in environmental conditions such as temperature and humidity or fluctuations in image forming conditions such as a developing bias.

Figure 7:
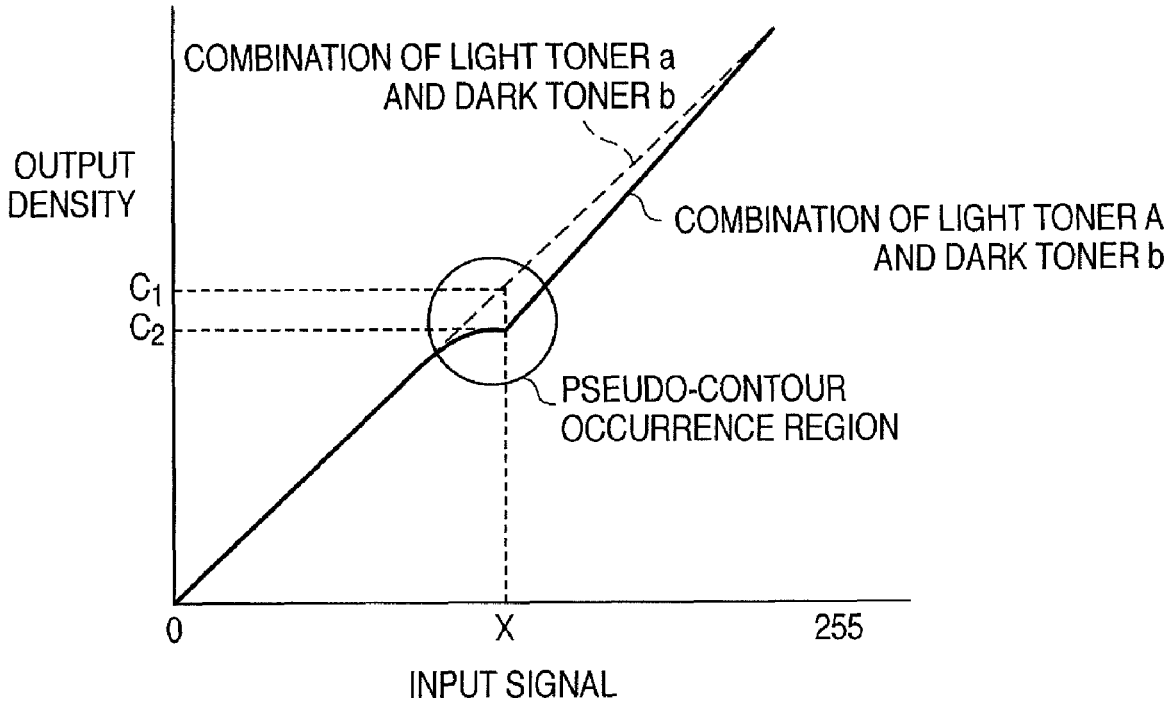
FIG. 7 is a schematic view showing output densities when the output characteristics of each toner shown in FIG. 5 and FIG. 6 are overlapped.

[Pseudo-contours: FIG. 7]

The influence on tone characteristics produced by combining a light toner and a dark toner, in a case in which the maximum density of the light toner falls as mentioned above, will be described using FIG. 7.

A dotted line in FIG. 7 shows the ideal state (target state) in a case where light to dark tone are reproduced by combining a light toner and a dark toner. More specifically, the output density linearly increases in proportion to the input signal of image data. The dotted line illustrates the result of combination of the light toner a and the dark toner b as shown in FIG. 5.

The solid line in FIG. 7 represents the tone characteristics in a case where the maximum density of the light toner is lowered. More specifically, when the level of the input signal of image data is in the vicinity of the position X as shown in FIG. 7, the output density does not linearly increase in proportion to the input signal of image data. For example, an output density corresponding to a state in which the level of an input signal is in the vicinity of the position X is a density C2 that is lower than an ideal target density C1. As a result, when reproducing light to dark tone by combining the light toner A and the dark toner b, pseudo-contours are generated when the level of the input signal is in the vicinity of the position X. The characteristics of the output density of the light toner and the dark toner at this time have been already shown in FIG. 6.

There is thus a problem that, when a drop in density occurs in a high density portion of light toner on reproducing light to dark tone of single color by combining a light toner and a dark toner, it degrades the image quality that the stability of reproduction of light to dark tone is lost and pseudo-contours appear.

Accordingly, in an image forming apparatus that reproduces all tones of the same hue by combining a light toner and a dark toner, it is particularly necessary to stably control the tone characteristics of a high density portion of light toner (area with a large amount of applied toner, or high applied amount portion) and a low density portion of dark toner (area with a low amount of applied toner, or low applied amount portion). Further, with respect to use of light toner also, similarly to dark toner, stably controlling a low density portion is essential in order to obtain rich tonal expression.

Thus, according to the image forming apparatus of the present embodiment as described above, density variation and tint variation are stably controlled by performing tone control as described in JPA 2003-228201. More specifically, when forming images of a plurality of sheets in succession, patch images are formed on an image carrier at non-image portions at which an image is not formed between an image area and another image area at which images are formed. Alternatively, when forming an image on only one sheet, a patch image is formed on the image carrier at a non-image portion immediately after an image area. Subsequently, the density (toner amount) of the thus-formed patch image is detected by a photo sensor, and based on a difference in the detected density and a target density, control is performed to correct LUT information at the γ-conversion processing unit 105*b* so as to stably maintain the density.

However, although JPA 2003-228201 describes tone control when using one kind of toner with respect to the same hue, it contains no description with regard to tone control in a case of reproducing light to dark tone by combining dark toner and light toner for the same hue.

Thus, according to the image forming apparatus of the present embodiment, in addition to performing the tone control as described in JPA 2003-228201, tone control is also performed to compensate for density fluctuations and tint fluctuations when reproducing tones by combining dark toner and light toner for the same hue. Hereunder, tone control that combines dark toner and light toner according to the image forming apparatus of the present embodiment is described.

Figure 8A:
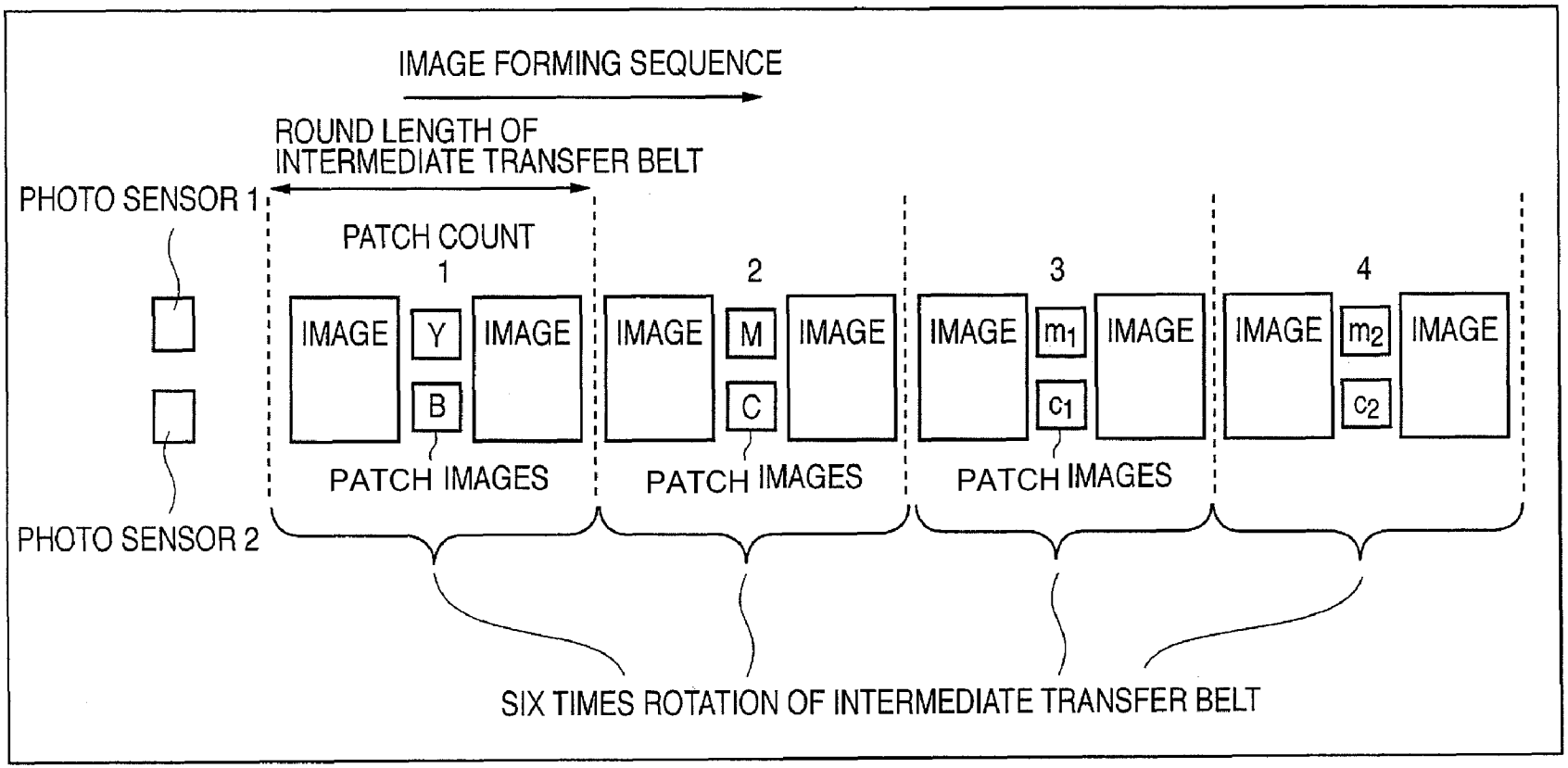
FIG. 8A is a view that illustrates a patch image forming sequence in which photo sensor two patch images are formed in spaces between images by the color image forming apparatus shown in FIG. 2A according to the first embodiment.

[Method of Forming a Patch Image: FIG. 8A]

According to the present image forming apparatus as described with FIG. 2A, it is possible to form two A4 size images side by side on an intermediate transfer member, and patch images for density control are formed between the two A4 size images. It is therefore possible to carry out tone control without consuming any special time for density control.

In this case, in the conveying direction of the intermediate transfer belt 5, the number of patch images that can be formed between two images on the intermediate transfer belt 5 is normally one or two in consideration of the operating speed of the image forming apparatus and the accuracy of the photo sensors and the like. Therefore, an example will now be described of a case of forming one patch image between images according to the present image forming apparatus. Further, in the following description, an example is described of a case in which two photo sensors detecting the density of patch images are disposed in a direction perpendicular to the conveying direction of the intermediate transfer belt 5. Accordingly, the present image forming apparatus can form two patch images between images. In this connection, the number of photo sensors is not limited to two, and the effect of the present invention is the same when the number of photo sensors is one or three.

Next, a method of forming a patch when using a combination of a dark toner and a light toner for the same hue is described using FIG. 1 and FIG. 8A.

FIG. 8A is a view that illustrates an image forming sequence of image areas on the intermediate transfer belt 5 and patch images formed between the image areas. In FIG. 8A, a sequence of two images formed on the intermediate transfer belt 5 of the image forming apparatus as shown in FIG. 2A is illustrated. The two images are formed by piling toner image of six colors during six times rotation of the intermediate transfer belt 5. FIG. 1 is a view that shows the patch image forming sequence and the relation of patch images that each photo sensor detects.

According to the present embodiment, for cyan and magenta formed using two toners consisting of a dark toner and a light toner for the same hues, patch images of two kinds of input signal levels (for example, levels 64 and 224) are formed for the light toners (light magenta and light cyan). More specifically, for the aforementioned reason, the patch images of the two kind of levels consisting of a low density portion (low applied amount portion) and a high density portion (high applied amount portion) are formed for the light toner. Further, a patch image of one level consisting of a low density portion (low applied amount portion) is formed for the dark toner. A signal level of the patch image using the dark toner is not level 128 or more in which the light toner and the dark toner are combined in FIG. 5, but less than level 128, for example level 64. This is by reason that a characteristic of image density vs. input signal level for the dark toner is controlled to be linear from low density portion. For yellow or black formed using one toner for the same hue, the patch for one level consisting of a low density portion (low applied amount portion) is formed in the same manner as for the dark toner.

In FIG. 8A, a photo sensor 1 sequentially detects the density of a patch image Y for yellow, a patch image M for dark magenta, a patch image m1 for light magenta (at high density), and a patch image m2 for light magenta (at low density) that are formed between images in the sequence shown in FIG. 1.

Similarly, a photo sensor 2 shown in FIG. 8A sequentially detects the density of a patch image B for black, a patch image C for dark cyan, a patch image c1 for light cyan (at high density), and a patch image c2 for light cyan (at low density) that are formed in the sequence shown in FIG. 1. Further, each time a patch image is detected at the photo sensor 1 or 2, the patch count values are increased in the order 1, 2, 3 and 4, respectively.

Thus, according to the present image forming apparatus, the number of patch images to be formed is, for each toner color, one (for dark toner of magenta and cyan and for yellow and black) or two (for light toner of magenta and cyan). Therefore, as shown in FIG. 8A, tone control for all colors is executed while forming A4 size images of eight sheets. More specifically, tone control of all colors is performed taking the period for successively forming eight A4 size images as one cycle. However, since it is sufficient to optimize this patch image forming frequency by taking into account the overall stability of the image forming apparatus or the running costs, the patch image forming frequency of the present invention is not limited to one time in a cycle of eight sheets.

[Tone Control Using Patch Images for Low Density Portion and High Density Portion: FIG. 9]

Next, the tone control method will be described using the flowchart shown in FIG. 9.

FIG. 9 is a flowchart illustrating a process executed by the CPU 101 shown in FIG. 3A while controlling each unit using the RAM 103 as a work area based on a density control program 202 that is stored in the ROM 102. This control is density control that is performed by forming patch images utilizing spaces between image areas when forming images in succession. The flowchart of FIG. 9 is described while referring to the example illustrated in FIG. 8A.

First, upon start of patch image forming for adjusting density, the operation proceeds to step S1 at which the CPU 101 sets M. For example, when executing tone control for all colors with one cycle in which eight A4 size images are formed as described above (two patch images are formed between each set of two images to yield a total of eight patch images), M=4 is set. Further, a control count value n is set to 0.

Next, in step S2, the CPU 101 detects a sheet count value N, and then proceeds to step S3. In step S3, the CPU 101 calculates the remainder by dividing the sheet count value N by M (=4). In this connection, the remainder in a case where the remainder is 0 is taken as 4. Accordingly, when the sheet count value N is 1, 2, 3 or 4, the remainder is 1, 2, 3 or 4, respectively.

Next, in step S4, the CPU 101 sends an instruction to the printer engine unit 106 to form patch images of colors and density levels (see FIG. 1) corresponding to the remainder. For example, when the remainder for sheet count value N/4 is 1, the CPU 101 instructs the printer engine unit 106 to form the patch images of patch forming sequence 1 (yellow and black) shown in FIG. 1. Similarly, when the remainder for sheet count value N/4 is 2, the CPU 101 sends an instruction to form the patch images of patch forming sequence 2 (dark magenta, dark cyan) shown in FIG. 1. Likewise, when the remainder for sheet count value N/4 is 3, the CPU 101 sends an instruction to form the patches of patch forming sequence 3 (light magenta (at high density) and light cyan (at high density)) shown in FIG. 1. Similarly, when the remainder for sheet count value N/4 is 4 (there is no remainder), the CPU 101 sends an instruction to form the patches of patch forming sequence 4 (light magenta (at low density) and light cyan (at low density)) shown in FIG. 1.

Next, in step S5, the CPU 101 performs control to detect the density of each of the formed patch images with the photo sensors 1 and 2, and calculates the difference between the detected densities and a reference (for example, a previously stored standard density).

Next, in step S6, the CPU 101 calculates a correction value based on a correction amount table and the calculated difference, and writes the value after corrected by the correction value in a lookup table for tone correction (for example, a LUT in the γ-conversion processing unit 105*b*). The method of calculating a correction value will now be described using FIG. 10 and FIG. 11.

Figure 10:
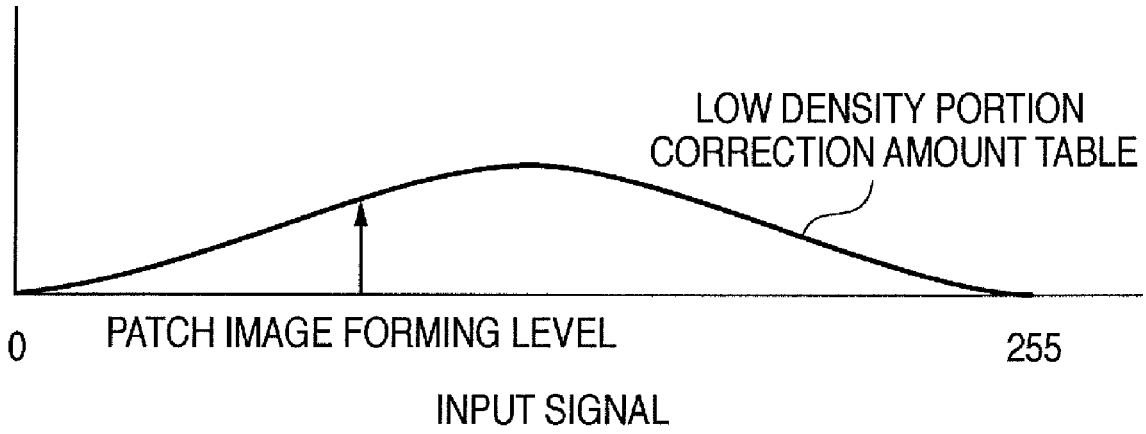
FIG. 10 is a correction amount table used for calculating a correction amount with respect to toner of a low density portion of light toner.
Figure 11:
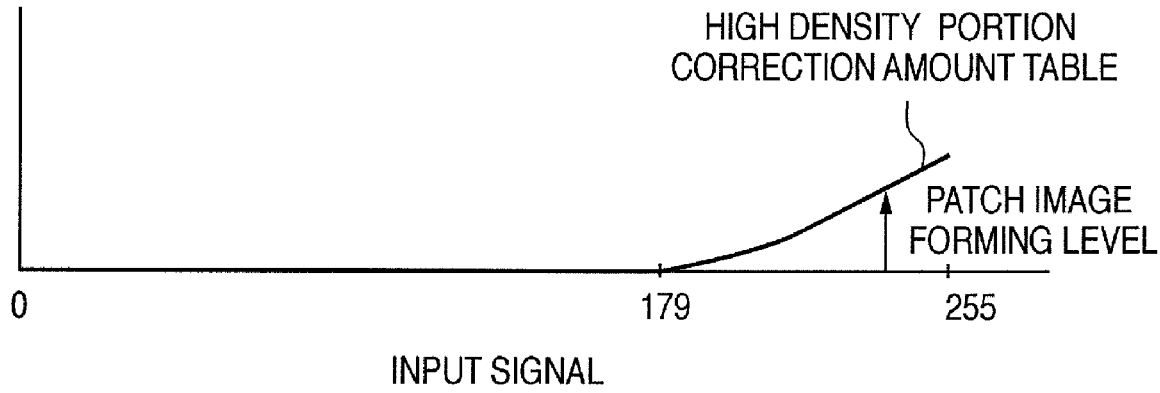
FIG. 11 is a correction amount table used for calculating a correction amount with respect to toner of a high density portion of light toner.

[Correction Amount Table: FIG. 10, FIG. 11]

FIG. 10 is a view that shows a correction amount table used to calculate a correction amount for a low density portion of light toner (light magenta or light cyan). According to the present embodiment, the tone of substantially all density range is controlled with a patch image of one level. Therefore, with respect to the correction amount table shown in FIG. 10, one patch of a predetermined density level as shown by the arrow in FIG. 10 is formed, the density of this patch image is detected to calculate the ratio with respect to a value corresponding to the same density level in the correction amount table, and thereby calculate a final correction value by multiplying the calculated ratio according to the correction amount table. In this connection, correction amount tables that are similar to that shown in FIG. 10 are prepared for dark toners (dark magenta and dark cyan) and for yellow and black using one toner for the same hue.

FIG. 11 shows a correction amount table that is used for calculating a correction value for a high density portion of a light toner (light magenta or light cyan). Since the table shown in FIG. 11 is mainly used to correct only a high density portion of a light toner (light magenta or light cyan), a correction amount table of this shape is used. More specifically, the correction amount table shown in FIG. 11 is for correcting a density range of approximately 70% or more of the maximum density of a light toner. Therefore, one patch of a predetermined density level (for example, level 236) as indicated by an arrow in FIG. 11 is formed for the correction amount table shown in FIG. 11, the density of this patch is detected to calculate the ratio with respect to the same density level of the correction amount table, and a final correction value is then calculated by multiplying the calculated ratio according to the correction amount table.

Thus, by using two correction amount tables that are suitable for density correction of a low density portion and a high density portion of light toner as described above, and using one correction amount table that is suitable for density correction of a low density portion of a dark toner, a stable density can be reproduced even when using two kinds of toner consisting of a dark toner and a light toner for the same hue. Therefore, since it is possible to stably reproduce the densities of a low density portion and a high density portion of a light toner and a low density portion of a dark toner, rich tone characteristics in which pseudo-contours do not arise can be consistently reproduced.

Next, the CPU 101 advances to step S7 to set the sheet count value N=N+1, and the control count value n=n+1. Next, in step S8, when n is not M (=4), the CPU 101 returns to step S3 to repeat the processing of steps S3 to S7 as described above. When n is M (=4), the CPU 101 advances to step S9 to end the series of operations.

As described above, according to the image forming apparatus of the present embodiment, when forming a patch image for density control, the density control is performed by forming a greater number of patch images that are developed using light developer than patch images that are developed using dark developer. Accordingly, even if a applied amount of light developer will fluctuate, that fluctuation can be compensated to prevent the occurrence of pseudo-contours that lower image quality. It is therefore possible to suppress fluctuations in image quality or tints of slightly light colors of halftones, and perform control so as to most stably reproduce variations in sensitive range with respect to the visual sensitivity of humans.

Modify of First Embodiment

Figure 8B:
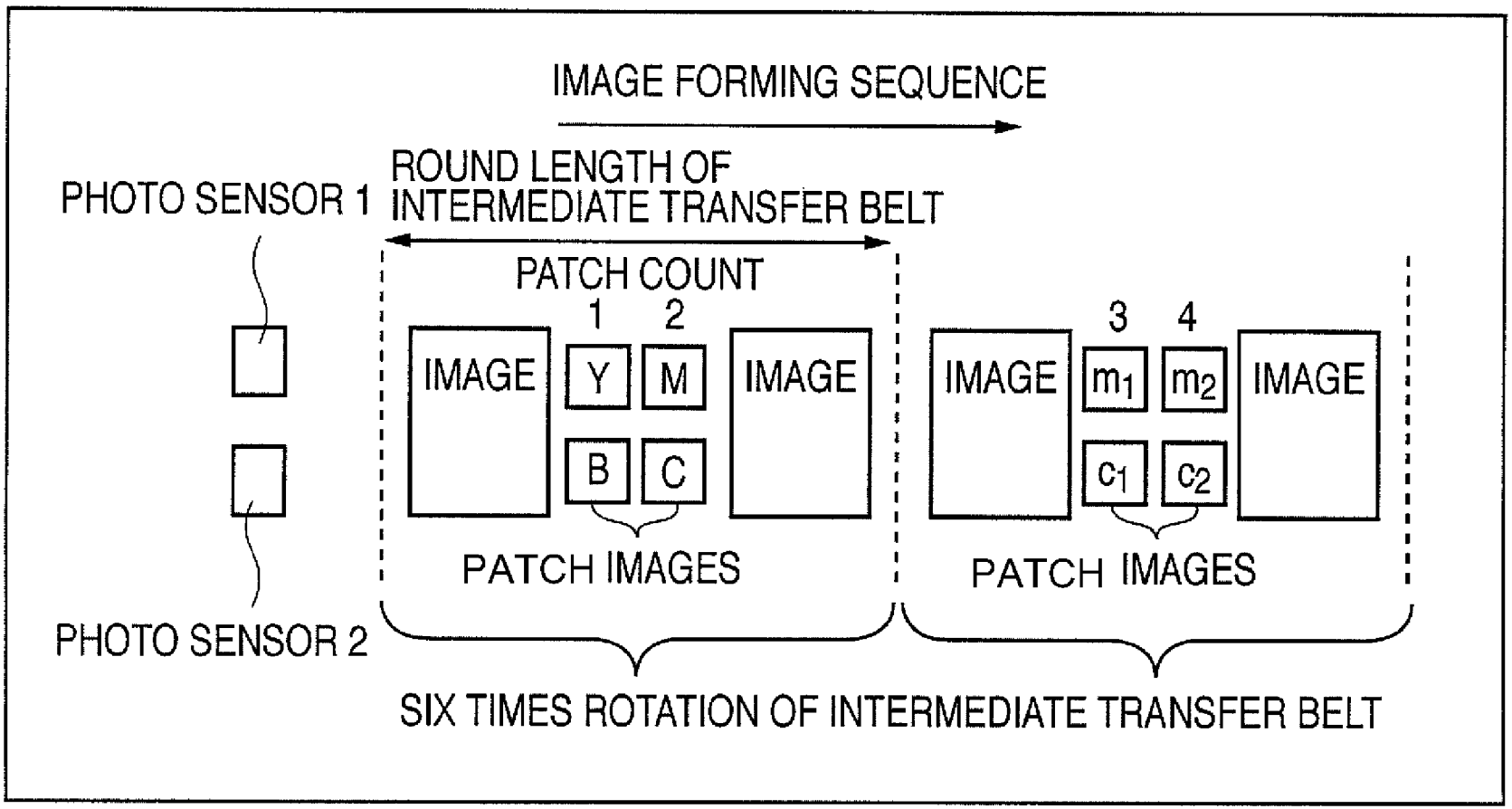
FIG. 8B is a view that illustrates a patch image forming sequence in which four patch images are formed in spaces between images by the color image forming apparatus shown in FIG. 2A according to the first embodiment.

As modified examples of the first embodiment, as shown in FIG. 8B, it may be possible to form two patch images between image areas in a conveying direction of the intermediate transfer belt 5 by enlarging a space area between image areas, though a longitudinal length of the intermediate transfer belt 5 must be longer. In the example of FIG. 8B, patch images of yellow Y, black B, dark magenta M and dark cyan C are formed between the first and second images, and patch images of light magenta m1 (at high density), light cyan c1 (at high density), light magenta m2 (at low density) and light cyan c2 (at low density) between the third and fourth images. A number of patch images between image areas in a conveying direction of the intermediate transfer belt 5 may be three or more.

Figure 8C:
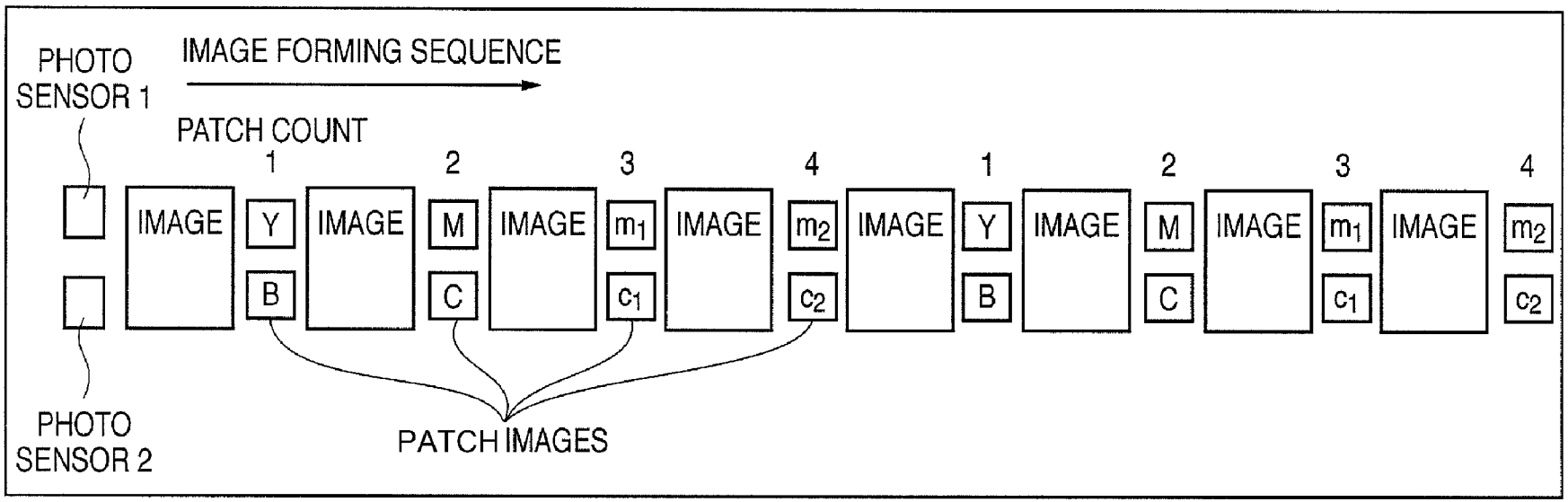
FIG. 8C is a view that illustrates a patch image forming sequence in which two patch images are formed in spaces between images by the color image forming apparatus shown in FIG. 2B according to the first embodiment.

In FIG. 8C, an image forming sequence of image areas on the intermediate transfer belt 5 and patch images formed between the image areas by the image forming apparatus as shown in FIG. 2B is illustrated. A sequence of patch images in FIG. 8C is the same as that of patch images in FIG. 8A by the image forming apparatus as shown in FIG. 2A.

Second Embodiment

The second embodiment is described hereunder. The image forming apparatus according to the second embodiment is similar to the image forming apparatus according to the first embodiment. Therefore, only portions that are different from the image forming apparatus of the first embodiment are described in the description of the image forming apparatus of the second embodiment, and a description of the common portions is omitted to avoid duplication.

[Characteristics of the Second Embodiment]

The image forming apparatus according to the second embodiment differs from the image forming apparatus according to the first embodiment with respect to the frequency of forming patch images of dark toner and light toner. More specifically, according to the image forming apparatus of the first embodiment, as shown in FIG. 1, the patch forming frequency consists of forming two patch images of light toner when forming one patch image of dark toner. However, according to the image forming apparatus of the second embodiment, as shown in FIG. 12, the difference is that the patch forming frequency is the same for forming patch images of light toner and patch images of dark toner. That is, when one patch image of a dark toner (dark magenta or dark cyan) is formed, one patch image of a light toner (light magenta at a high density or low density, or light cyan at a high density or low density) is formed. The reason for making the forming frequency for a dark toner and a light toner the same in this manner is that, since the toner density differs with respect to a dark toner and a light toner, the influence of a change in density when an applied amount of toner changes is reduced. By making the patch forming frequency the same for a dark toner and a light toner, the control of tone characteristics in an image forming apparatus using a dark toner and a light toner can be reproduced with better balance.

Figure 13A:
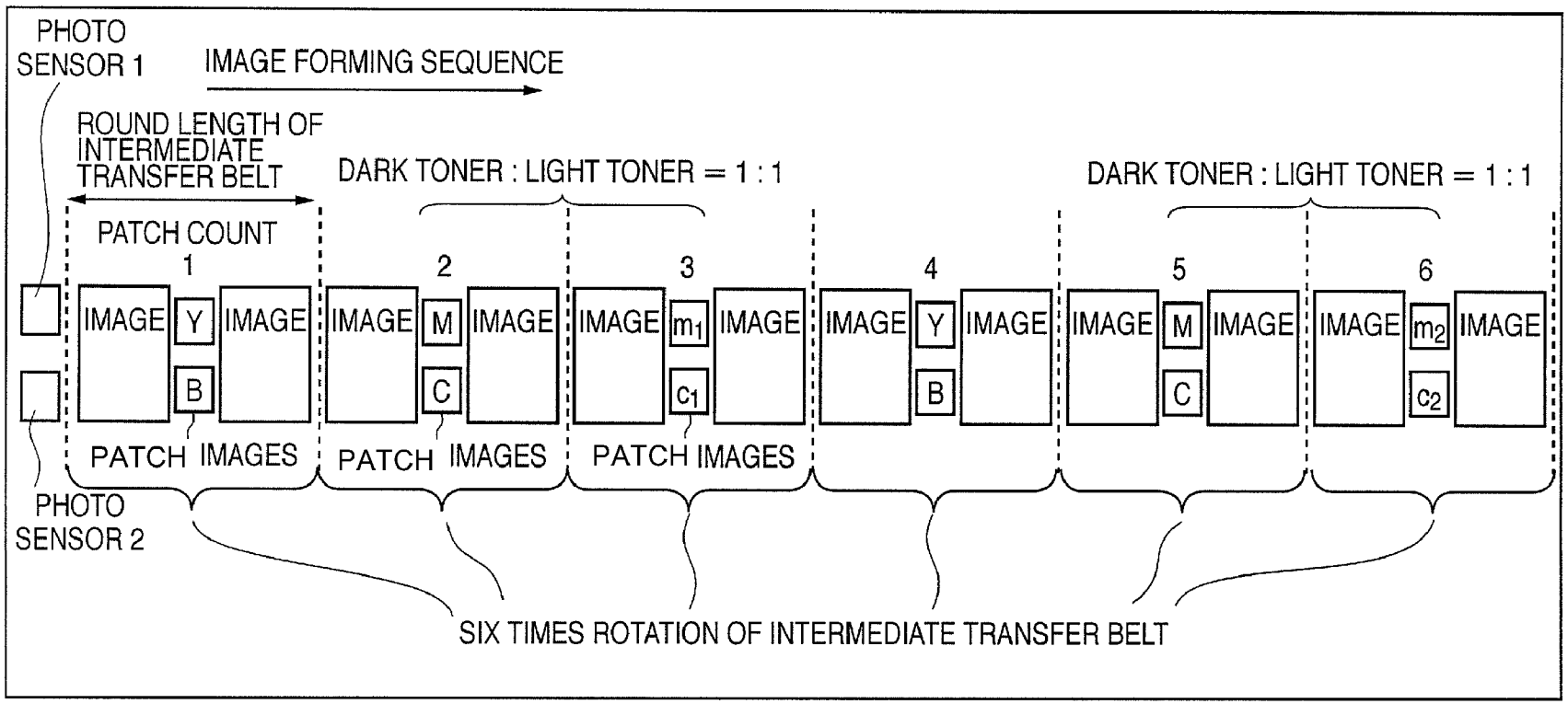
FIG. 13A is a view that illustrates a patch image forming sequence in which photo sensor two patch images are formed in spaces between images by the color image forming apparatus shown in FIG. 2A according to the second embodiment.

Hereunder, the patch forming method that is used in the image forming apparatus according to the present embodiment is described using FIGS. 12 and FIG. 13A.

[Patch Formation Method: FIGS. 12 and 13A]

The density variation for dark toner is naturally greater than that for light toner when the applied amount of toner varies. The variation in toner amount is also a primary cause of density variation in image forming apparatus adopting the electrophotographic method. Consequently, when the same control is implemented for dark toner and for light toner, the stability with respect to density variations is higher in the portions of light toner than the portions of dark toner. Therefore, according to the present embodiment, density control is performed through which tone reproduction with good balance can be consistently obtained for tone characteristics produced by combining dark and light toners.

According to the second embodiment, for example, a design is adopted such that the maximum amount of applied toner for both dark toner and light toner is 0.5 mg/cm$^2$ on a sheet, and the maximum density (optical density) is 1.6 for the dark toner and 0.8 for the light toner. Thus, when variations in the applied amounts are the same for both the dark toner and the light toner, the dark toner will have a density variation that is approximately twice that of the light toner. Therefore, the overall balance will be better if the density varying amounts for the dark toner and the light toner are made uniform. Accordingly, by making the variations in the amounts of applied dark toner approximately half the variations in the amounts of applied light toner, the density varying amounts of the dark toner and the light toner can be made uniform.

Since it has been found that there is a high correlation between fluctuations in the amounts of applied toner and the number of sheets for image forming, the second embodiment achieved the objective of making the density varying amounts of dark toner and light toner uniform as described above by controlling the patch forming frequency.

The patch forming frequency according to the present embodiment is set as shown in FIG. 12. FIG. 13A is a view that illustrates an image forming sequence of image areas on the intermediate transfer belt 5 and patch images formed between the image areas according to the second embodiment. In FIG. 13A, a sequence of two images formed on the intermediate transfer belt 5 of the image forming apparatus as shown in FIG. 2A is illustrated. The two images are formed by piling toner images of six colors during six times rotation of the intermediate transfer belt 5. In FIG. 13A, the photo sensor 1 sequentially detects the respective densities of six patch images for yellow Y, dark magenta M, light magenta m1 (at high density), yellow Y, dark magenta M, and light magenta m2 (at low density). Likewise, the photo sensor 2 sequentially detects the respective densities of six patches for black B, dark cyan C, light cyan c1 (at high density), black B, dark cyan C, and light cyan c2 (at low density). Further, each time a patch image is detected at the photo sensor 1 or 2, the patch count values are increased in the order 1, 2, 3, 4, 5 and 6, respectively.

That is, according to the present embodiment, the patch forming frequencies for dark toner patch images and light toner patch images (including patch images of a high density portion and a low density portion) are made the same while making the number of density levels of the light toner patch images greater than the number of density levels of the dark toner patch images as shown in FIG. 13A. Thus, well-balanced reproduction can be consistently obtained for tone characteristics obtained by combining dark and light toners.

Figure 14:
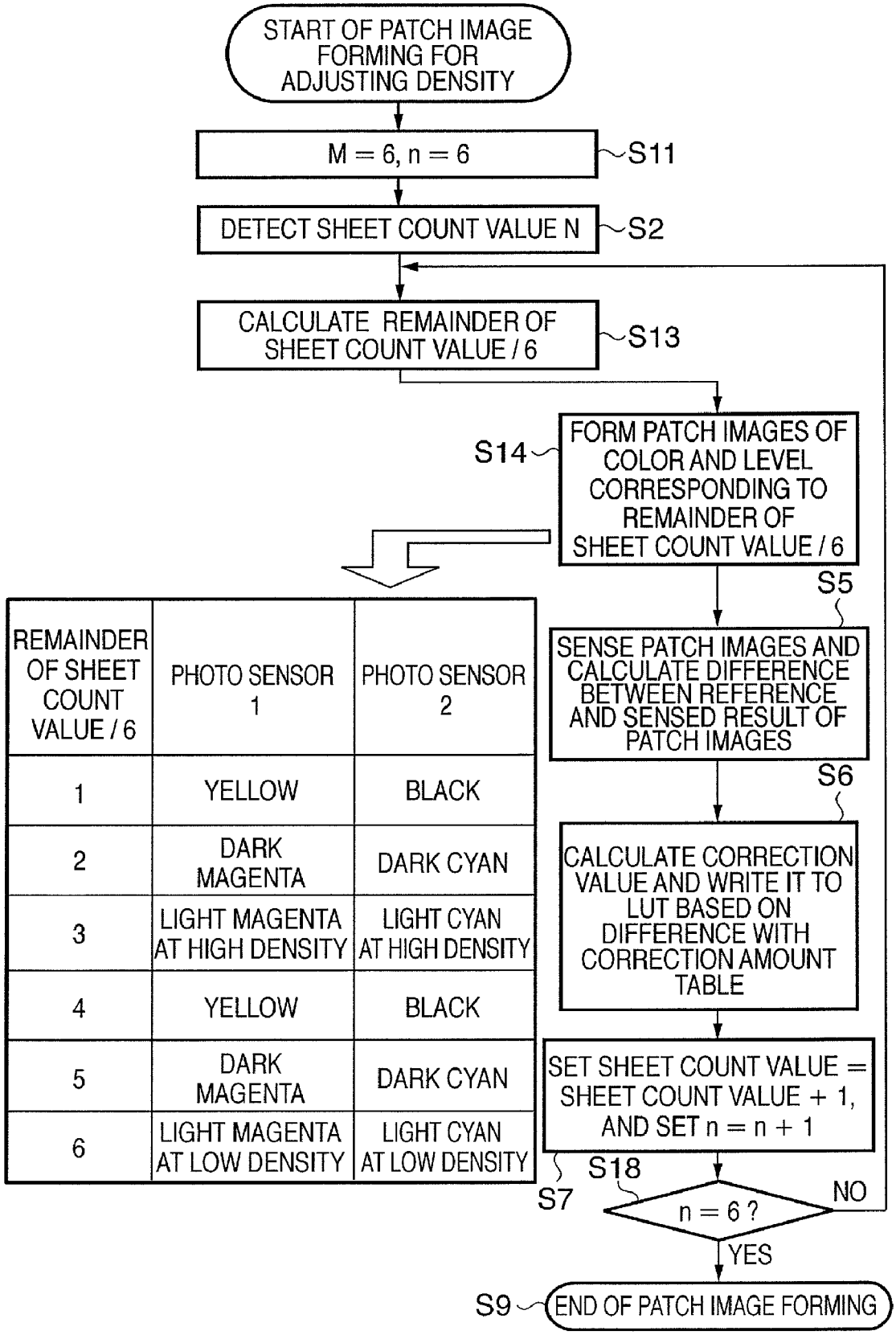
FIG. 14 is a flowchart that illustrates tone control processing in a color image forming apparatus according to the second embodiment.

[Tone Control Using Patch Images for Low Density Portion and High Density Portion: FIG 14]

The tone control method according to the second embodiment can be implemented with the flowchart shown in FIG. 14, which is a slightly modified version of the flowchart already shown in FIG. 9. In the flowchart shown in FIG. 14, processing that is common to the flowchart shown in FIG. 9 is denoted by the same step number and a description thereof is omitted to avoid duplication, and only steps that are different to the flowchart shown in FIG. 9 are described hereunder.

FIG. 14 is a flowchart illustrating a process executed by the CPU 101 shown in FIG. 3A while controlling each unit using the RAM 103 as a work area based on a density control program 202 that is stored in the ROM 102. This control is a density control that is performed by forming patch images utilizing spaces between images when forming images in succession. The flowchart shown in FIG. 14 will be described while referring to the example illustrated in FIG. 13A.

First, upon start of forming patch images for density control, the operation proceeds to step S11 in which the CPU 101 sets M. For example, when executing tone control for all colors with one cycle in which 12 A4 size images are formed as described above (two patch images are formed between each set of two images to yield a total of 12 patch images), M=6 is set. Further, the control count value n is set to 0.

Next, in step S2, the CPU 101 detects a sheet count value N, and then proceeds to step S13. In step S13, the CPU 101 calculates the remainder by dividing the sheet count value N by M (=6). In this connection, the remainder in a case where the remainder is 0 is taken as 6. Accordingly, when the sheet count value N is 1, 2, 3, 4, 5 or 6, the remainder is 1, 2, 3, 4, 5 or 6, respectively.

Next, in step S14, the CPU 101 sends an instruction to the printer engine unit 106 so as to form patch images of colors and density levels (see FIG. 12) corresponding to the remainder of sheet count value N/6. For example, when the remainder for sheet count value N/6 is 1, the CPU 101 instructs the printer engine unit 106 to form the patch images of patch forming sequence 1 (yellow and black) shown in FIG. 12. Similarly, when the remainder for sheet count value N/6 is 2, the CPU 101 instructs the printer engine unit 106 to form the patch images of patch forming sequence 2 (dark magenta and dark cyan) shown in FIG. 12. Likewise, when the remainder for sheet count value N/6 is 3, the CPU 101 instructs the printer engine unit 106 to form the patch images of patch forming sequence 3 (light magenta (at high density) and light cyan (at high density)) shown in FIG. 12. Similarly, when the remainder for sheet count value N/6 is 4, the CPU 101 instructs the printer engine unit 106 to form the patch images of patch forming sequence 4 (yellow and black) shown in FIG. 12. Similarly when the remainder for sheet count value N/6 is 5, the CPU 101 instructs the printer engine unit 106 to form the patch images of patch forming sequence 5 (dark magenta and dark cyan) shown in FIG. 12. Similarly, when the remainder for sheet count value N/6 is 6 (there is no remainder), the CPU 101 instructs the printer engine unit 106 to form the patches of patch forming sequence 6 (light magenta (at low density) and light cyan (at low density)) shown in FIG. 12.

Next, the CPU 101 executes the processing of step S5 to step S7. Since the processing of these steps is the same as the processing described with respect to FIG. 9, a description thereof is omitted here. In step S18 of FIG. 14, the CPU 101 determines whether or not n=6.

Modify of Second Embodiment

Figure 13B:
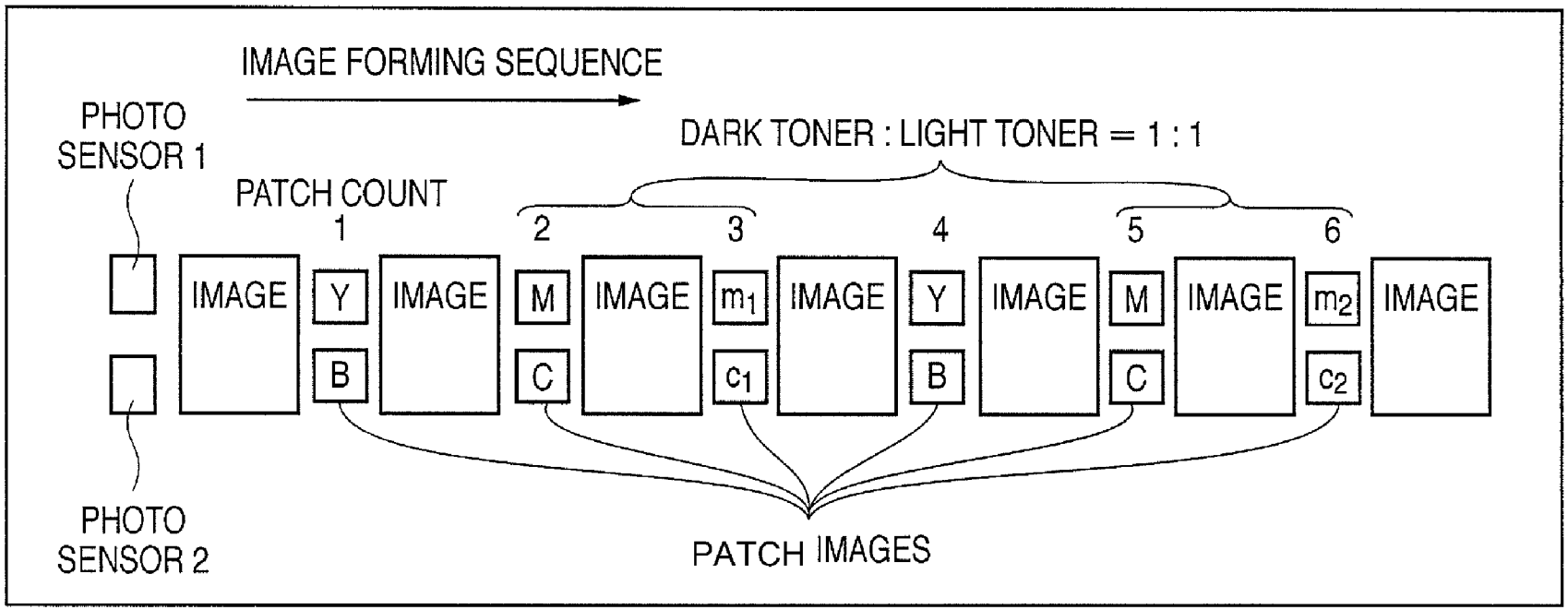
FIG. 13B is a view that illustrates a patch image forming sequence in which two patch images are formed in spaces between images by the color image forming apparatus shown in FIG. 2B according to the second embodiment.

In FIG. 13B, an image forming sequence of image areas on the intermediate transfer belt 5 and patch images formed between the image areas by the image forming apparatus as shown in FIG. 2B is illustrated, according to the second embodiment. A sequence of patch images in FIG. 13B is the same as that of patch images in FIG. 13A by the image forming apparatus as shown in FIG. 2A.

Other Embodiments

It is to be understood that the object of the present invention may also be accomplished by supplying a system or an apparatus with a storage medium in which a program code of software which realizes the functions of the above described embodiments is stored, and causing a computer (or CPU or MPU) of the system or apparatus to read out and execute the program code stored in the storage medium.

In this case, the program code itself read from the storage medium realizes the functions of the above described embodiments, and hence the program code and the storage medium in which the program code is stored constitutes the present invention.

Examples of the storage medium for supplying the program code include a floppy (registered trademark) disk, a hard disk, a magnetic-optical disk, a CD-ROM, a CD-R, a CD-RW, a DVD-ROM, a DVD-RAM, a DVD-RW, a DVD+RW, a magnetic tape, a non-volatile memory card, and a ROM. Alternatively, the program code may be downloaded via a network.

Further, it is to be understood that the functions of the above described embodiments may be accomplished not only by executing a program code read out by a computer, but also by causing an OS (operating system) or the like which operates on the computer to perform a part or all of the actual operations based on instructions of the program code.

Further, it is to be understood that the functions of the above described embodiments may be accomplished by writing a program code read out from the storage medium into a memory provided on an expansion board inserted into a computer or in an expansion unit connected to the computer and then causing a CPU or the like provided in the expansion board or the expansion unit to perform a part or all of the actual operations based on instructions of the program code.

Furthermore, besides the case where the functions according to the above described embodiments are implemented by executing the read program by computer, an operating system or the like running on the computer may perform all or a part of the actual processing based on the instructions of the program so that the functions of the above described embodiments can be implemented by this processing.

In this case, the program code may be supplied directly from a storage medium on which the program code is stored or by downloading the program code from another computer, database, or the like, not shown, that is connected to the Internet, a commercial network, a local area network or the like.

The above embodiments have exemplified an application of the present invention to an image forming apparatus which prints in accordance with the electrophotographic method. However, the present invention is not limited to the electrophotographic method, and can also be applied to various kinds of printing methods including an ink jet method, a thermal transfer method, a thermosensitive method, an electrostatic method, and a discharge breakdown method.

It is further noted that the above program may be in any format, for example, object code, a program code to be executed by an interpreter, or script data supplied to an OS (operating system).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-299381, filed on Nov. 2, 2006, which is hereby incorporated by reference herein in its entirety.

What is claimed is:

1. An image forming apparatus comprising:

an image forming portion adapted to form images representing a same hue by a combination of developers having different tone;

a measurement image forming portion adapted to form images for measurement in an area between the images to be formed on an image carrier using said image forming portion during forming images in succession transferred on a plurality of recording media;

a measurement portion adapted to measure densities of the images for measurement; and a density adjusting portion adapted to adjust densities of the images formed by said image forming portion, based on the densities of the images for measurement measured by said measurement portion, wherein said measurement image forming portion forms images for measurement so that a number of density levels of images for measurement developed using a light developer for a same hue is larger than a number of density levels of images for measurement developed using a dark developer for the same hue.

2. The apparatus according to claim 1, further comprising a setting portion adapted to make a setting such that a density level of at least an image for measurement among a plurality of images for measurement developed using the light developer is higher than a density level of the image for measurement developed using the dark developer.

3. The apparatus according to claim 2, wherein the density level of at least an image for measurement among a plurality of images for measurement developed using the light developer is 70% or more level of a maximum density of images formed using the light developer.

4. The apparatus according to claim 1, wherein said measurement image forming portion controls said image forming portion so that images for measurement developed using the light developer and images for measurement developed using the dark developer are formed at a same frequency.

5. The apparatus according to claim 1, wherein said image forming apparatus includes developing portions for hues of cyan, magenta and yellow, and develops hues of cyan or magenta with a combination of a light developer and a dark developer.

6. A method of controlling an image forming apparatus which forms images representing at least a same hue by a combination of developers having different tone, comprising the steps of:

forming images for measurement in an area between the images formed on an image carrier during forming images in succession transferred on a plurality of recording media;

measuring densities of the images for measurement; and adjusting densities of the images formed in said image forming step, based on the densities of the images for measurement measured in said measuring step, wherein in said step of forming images for measurement, images for measurement are formed so that a number of density levels of images for measurement developed using a light developer for a same hue is larger than a number of density levels of images for measurement developed using a dark developer for the same hue.

7. A computer-readable storage medium which stores a program for causing a computer to execute a method of controlling an image forming apparatus according to claim 6.

* * * * *